US010065436B2

(12) United States Patent
Takasugi et al.

(10) Patent No.: US 10,065,436 B2
(45) Date of Patent: Sep. 4, 2018

(54) INKJET RECORDING APPARATUS

(71) Applicant: Roland DG Corporation, Hamamatsu-shi, Shizuoka (JP)

(72) Inventors: Masahiro Takasugi, Hamamatsu (JP); Takeshi Yagi, Hamamatsu (JP); Mitsuhiro Kato, Hamamatsu (JP); Masanori Ishihara, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/686,283

(22) Filed: Aug. 25, 2017

(65) Prior Publication Data

US 2018/0065381 A1 Mar. 8, 2018

(30) Foreign Application Priority Data

Sep. 5, 2016 (JP) ..... 2016-173013

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS

| | | | | |
|---|---|---|---|---|
| 9,757,960 | B2 * | 9/2017 | Weglicki | B41J 11/002 |
| 9,884,489 | B2 * | 2/2018 | Ohnishi | B41J 11/002 |
| 2006/0044376 | A1 * | 3/2006 | Baird | B41J 3/4073 347/102 |
| 2014/0227494 | A1 | 8/2014 | Furuhata et al. | |

FOREIGN PATENT DOCUMENTS

JP 5817059 B2 11/2015

* cited by examiner

*Primary Examiner* — Lamson Nguyen
(74) *Attorney, Agent, or Firm* — Keating & Bennett, LLP

(57) ABSTRACT

A printer includes a first controller to cause a primer discharge head to discharge, from its nozzle, primer onto a recording medium and then cause a first ultraviolet light applicator to apply ultraviolet light to the primer, thus forming a first primer layer on the recording medium; a second controller to cause the primer discharge head to discharge, from its nozzle, the primer onto the first primer layer and the recording medium and then cause a second ultraviolet light applicator to apply ultraviolet light to the primer, thus forming a second primer layer on the first primer layer and the recording medium; and a third controller to cause an ink discharge head to discharge, from its nozzle, image-forming ink onto the second primer layer and then cause the first ultraviolet light applicator to apply ultraviolet light to the image-forming ink, thus forming an ink layer on the second primer layer.

9 Claims, 9 Drawing Sheets

INKJET RECORDING APPARATUS

CROSS REFERENCE TO RELATED APPLICATIONS

This application claims the benefit of priority to Japanese Patent Application No. 2016-173013 filed on Sep. 5, 2016. The entire contents of this application are hereby incorporated herein by reference.

BACKGROUND OF THE INVENTION

1. Field of the Invention

The present invention relates to inkjet recording apparatuses.

2. Description of the Related Art

An inkjet printer that uses photo-curable ink (which may hereinafter be simply referred to as a "photo-curing printer") is known. A photo-curing printer discharges photo-curable ink from a discharge head and applies light to the ink discharged. Thus, the ink is rapidly cured and forms an ink layer on a recording medium so as to print a desired image on the recording medium.

In one example, a photo-curing printer may effect printing on a non-ink-absorbing recording medium, such as a resin material or a metal material. Photo-curable ink, however, has poor fixability to such a recording medium, making it difficult to effect high-quality printing. To cope with this problem, Japanese Patent No. 5817059 discloses an inkjet recording apparatus that discharges adhesive primer onto a surface of a non-ink-absorbing recording medium so as to form a primer layer, and then discharges photo-curable ink onto the primer layer so as to effect printing. Forming a primer layer increases fixability of photo-curable ink to a recording medium. Thus, the inkjet recording apparatus is able to suitably effect high-quality printing on a recording medium to which photo-curable ink has poor fixability.

Although fixability of an ink layer to a recording medium is increased by forming a primer layer on the recording medium and forming the ink layer on the primer layer, adhesion between the recording medium and the primer layer may be insufficient depending on how the primer layer is formed. Even if a high-quality ink layer is formed on a primer layer, insufficient adhesion between the primer layer and recording medium may unfortunately cause the primer layer to be peeled off the recording medium.

SUMMARY OF THE INVENTION

Accordingly, preferred embodiments of the present invention provide inkjet recording apparatuses that enhance adhesion between a primer layer and a recording medium.

The inventors of preferred embodiments of the present invention conducted extensive research and discovered a solution involving discharging primer onto a recording medium so as to form a primer layer, and then further discharging primer onto the primer layer and the recording medium so as to form another primer layer, thus enhancing adhesion of the primer layers to the recording medium.

An inkjet recording apparatus according to a preferred embodiment of the present invention includes a platen, a primer discharge head, an ink discharge head, a light source, a first moving mechanism, a second moving mechanism, and a controller. A recording medium is to be placed on the platen. The primer discharge head discharges photo-curable primer onto the recording medium. The primer discharge head is provided with a first nozzle. The ink discharge head discharges image-forming ink onto the recording medium. The image-forming ink is photo-curable and less adhesive than the primer. The ink discharge head is provided with a second nozzle. The light source applies light to the primer and the image-forming ink discharged onto the recording medium. The first moving mechanism causes the primer discharge head and the ink discharge head to move in a main scanning direction corresponding to a width direction of the recording medium. The second moving mechanism causes the recording medium placed on the platen to move in a sub-scanning direction perpendicular to the main scanning direction. The controller is configured or programmed to control the primer discharge head, the ink discharge head, the light source, the first moving mechanism, and the second moving mechanism. The controller includes a first controller, a second controller, and a third controller. The first controller causes the primer discharge head to discharge, from the first nozzle, the primer onto the recording medium and then cause the light source to apply light to the primer discharged, thus forming a first primer layer on the recording medium. The second controller causes the primer discharge head to discharge, from the first nozzle, the primer onto the first primer layer and the recording medium and then cause the light source to apply light to the primer discharged, thus forming a second primer layer on the first primer layer and the recording medium. The third controller causes the ink discharge head to discharge, from the second nozzle, the image-forming ink onto the second primer layer and then cause the light source to apply light to the image-forming ink discharged, thus forming an image-forming ink layer on the second primer layer.

An inkjet recording apparatus according to a preferred embodiment of the present invention is constructed such that the first controller forms the first primer layer on the recording medium, the second controller forms the second primer layer on the first primer layer and the recording medium, and the third controller forms the image-forming ink layer (which may hereinafter be simply referred to as an "ink layer") on the second primer layer. Forming the second primer layer on the first primer layer and the recording medium in this manner enhances adhesion between the first primer layer and the recording medium. Forming the ink layer on the second primer layer improves the ink layer in quality and increases fixability of the ink layer to the recording medium.

Various preferred embodiments of the present invention provide inkjet recording apparatuses that enhance adhesion between a primer layer and a recording medium.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Inkjet recording apparatuses according to preferred embodiments of the present invention will be described below with reference to the drawings. An inkjet recording apparatus according to a preferred embodiment of the present invention is an inkjet printer 100 to effect printing on a recording medium. The inkjet printer 100 will hereinafter be referred to as a "printer 100". Preferred embodiments described below are naturally not intended to limit the present invention in any way. Components and elements having the same functions are identified by the same reference signs, and description thereof will be simplified or omitted when deemed redundant.

First Preferred Embodiment

Figure 1:
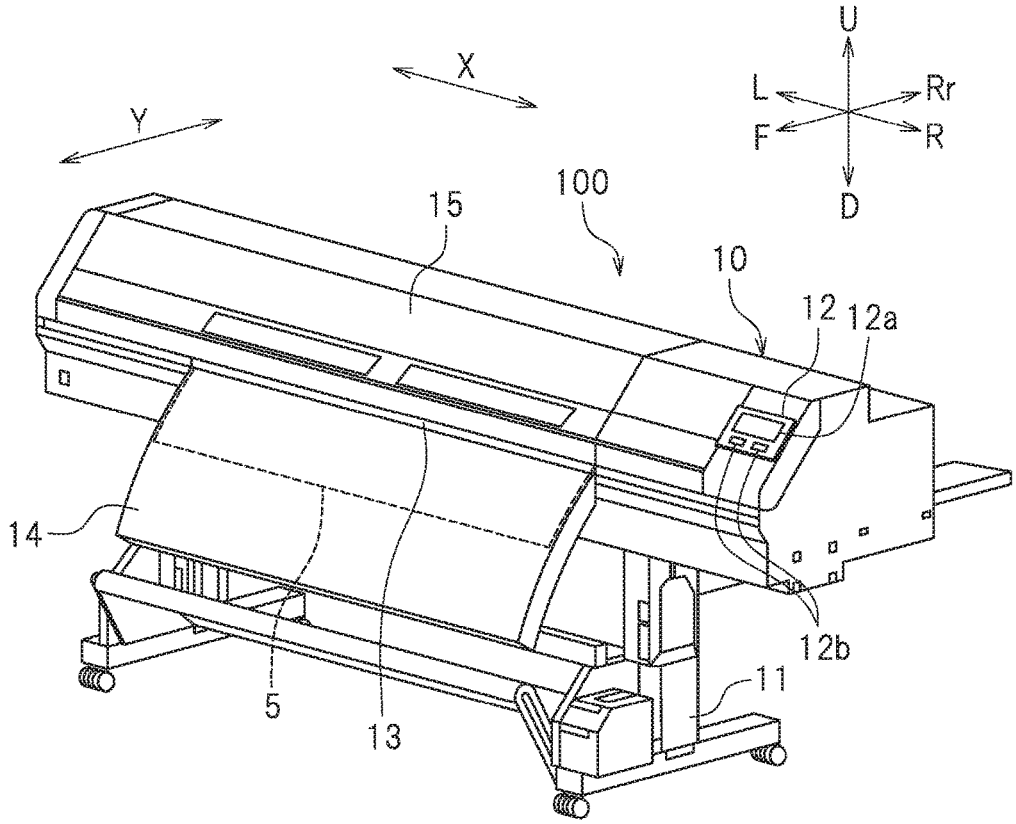
FIG. 1 is a perspective view of a printer according to a first preferred embodiment of the present invention.

FIG. 1 is a perspective view of the printer 100 according to a first preferred embodiment of the present invention. The terms "right", "left", and "down" in the following description respectively refer to right, left, up, and down with respect to an operator facing the front of the printer 100. The direction away from the printer 100 and toward the operator corresponds to a forward direction. The direction away from the operator and toward the printer 100 corresponds to a rearward direction. The reference signs "F", "Rr", "R", "L", "U", and "D" in the drawings respectively represent front, rear, right, left, up, and down. The reference sign X in the drawings represents a main scanning direction. In this preferred embodiment, the main scanning direction X is a right-left direction. The main scanning direction X corresponds to the width direction of a recording medium 5. The reference sign Y in the drawings represents a sub-scanning direction. The sub-scanning direction Y is a direction that intersects the main scanning direction X (e.g., a direction that vertically intersects the main scanning direction X in a plan view). In this preferred embodiment, the sub-scanning direction Y is a front-rear direction. The sub-scanning direction Y corresponds to the longitudinal direction of the recording medium 5. These directions are defined merely for the sake of convenience and should not be construed as being limiting in any way.

As illustrated in FIG. 1, the printer 100 is an inkjet printer. The printer 100 effects printing on the recording medium 5. A material for the recording medium 5 is not limited to any particular type of material. The recording medium 5 may be a permeable sheet or film that is permeable to photo-curable image-forming ink (e.g., process color ink or metallic ink) and photo-curable primer, or may be a non-permeable sheet or film that is permeable neither to photo-curable image-forming ink nor to photo-curable primer. In one example, the recording medium 5 may be, for instance, a coated sheet or coated film provided by applying a material, such as resin, to a surface of a base material permeable to photo-curable image-forming ink and photo-curable primer.

Examples of the permeable sheet or film include paper, such as plain paper and inkjet printable paper. Examples of the non-permeable sheet or film include: a sheet or film made of resin, such as polyester resin (e.g., polyethylene terephthalate (PET) resin, or polyethylene naphthalate (PEN) resin), polyolefin resin (e.g., polyethylene (PE) resin, polypropylene (PP) resin, or ethylene-propylene copolymer), polyether resin (e.g., polyurethane resin), polycarbonate (PC) resin, polyimide resin, polyamide resin, fluororesin, or acrylic resin (e.g., polymethyl methacrylate (PMMA) resin); a sheet or film made of metal, such as stainless steel, aluminum, iron, or copper; a sheet or film made of glass; a sheet or film made of rubber; and a composite sheet or film provided by a combination of two or more of these materials. Examples of the coated sheet or coated film include enamel paper, art paper, coated paper, cast-coated paper, mat paper, and glossy paper.

As illustrated in FIG. 1, the printer 100 includes: a body 10 including a casing; legs 11 provided on the lower surface of the body 10; an operation interface 12 through which a user performs a printing-related operation; and a cover 15 provided on the upper portion of the body 10. The operation interface 12 includes a display screen 12*a* and an operation input 12*b*. The display screen 12*a* presents printing-related information, such as information indicative of black-and-white printing or color printing, resolution, primer discharge patterns (which will be described below), and ink concentration. The user enters printing-related information through the operation input 12*b*.

As illustrated in FIG. 1, the body 10 is provided at its front portion with an outlet 13. The outlet 13 is located below the cover 15. The recording medium 5 is discharged through the outlet 13. A guide 14 is provided forward of and below the outlet 13. The guide 14 guides the recording medium 5 discharged through the outlet 13.

Figure 2:
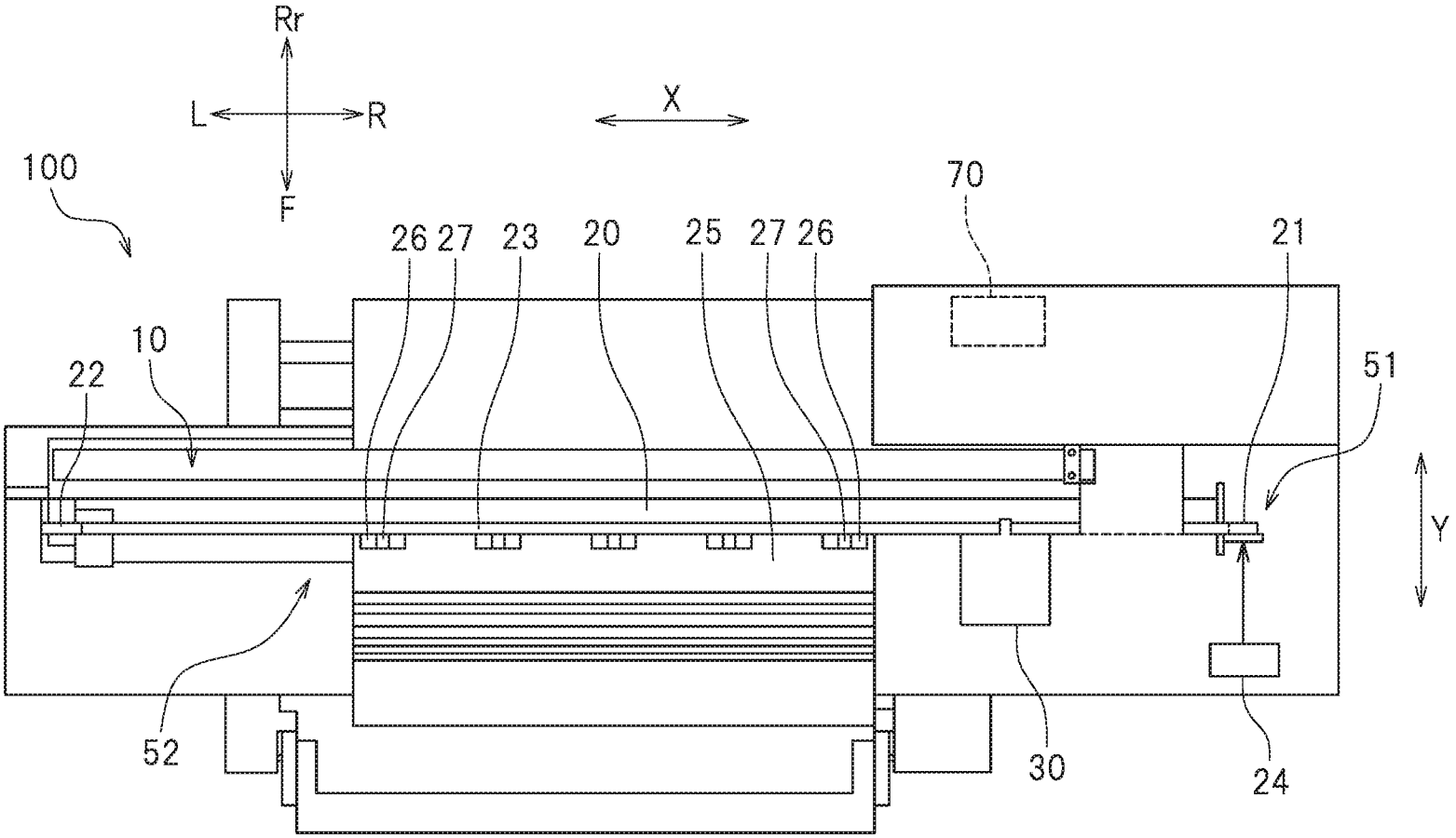
FIG. 2 is a plan view of the inner structure of the printer according to the first preferred embodiment of the present invention.
Figure 3:
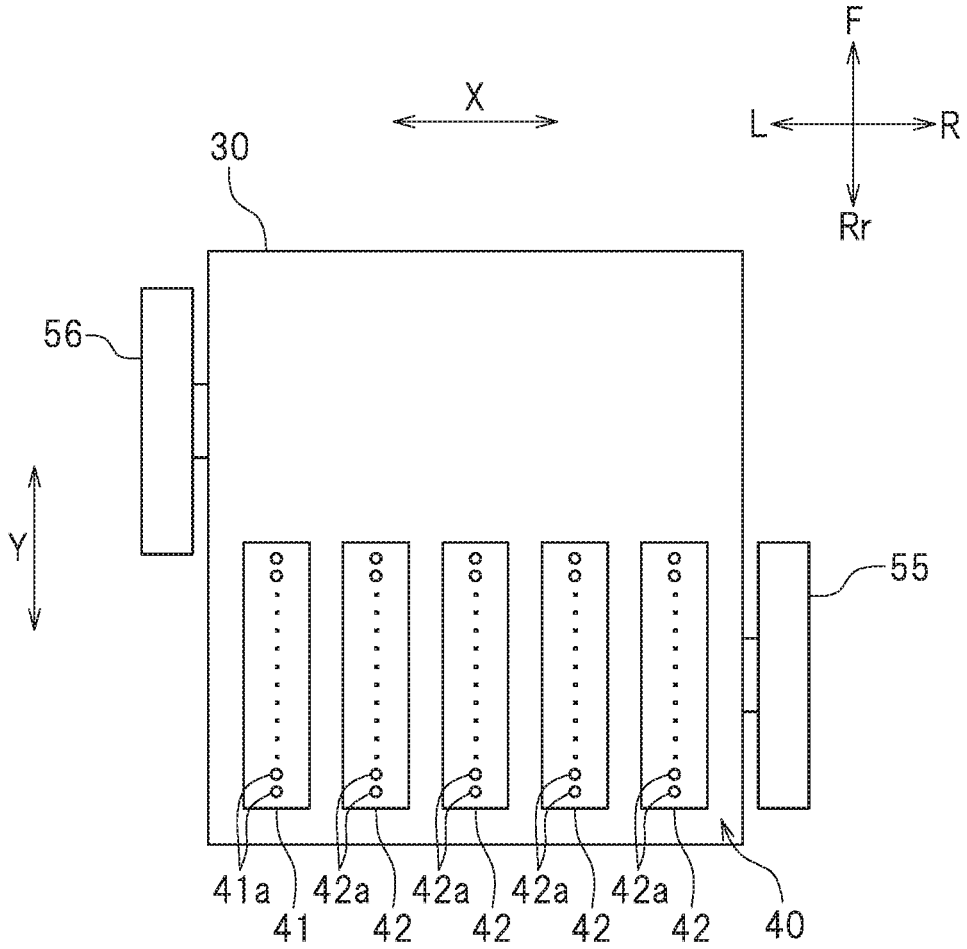
FIG. 3 is a bottom view of a head according to the first preferred embodiment of the present invention.

FIG. 2 is a plan view of the inner structure of the printer 100. FIG. 3 is a bottom view of a head 40. As illustrated in FIG. 2, the printer 100 further includes a guide rail 20, a platen 25, a first moving mechanism 51, a second moving mechanism 52, a carriage 30, the head 40 (see FIG. 3), a first ultraviolet light applicator 55 (see FIG. 3), a second ultraviolet light applicator 56 (see FIG. 3), and a controller 70.

As illustrated in FIG. 2, the guide rail 20 is disposed below the cover 15 (see FIG. 1). The guide rail 20 extends in the main scanning direction X.

The platen 25 supports the recording medium 5 when printing is effected on the recording medium 5. The recording medium 5 is placed on the platen 25. Printing is effected on the recording medium 5 on the platen 25. In this preferred embodiment, the platen 25 extends in the main scanning direction X. The platen 25 is disposed below the guide rail 20. The platen 25 is continuous with the guide 14 (see FIG. 1).

The first moving mechanism 51 causes the head 40 (see FIG. 3) to move in the main scanning direction X. As illustrated in FIG. 2, the first moving mechanism 51 includes a first pulley 21, a second pulley 22, an endless belt 23, and a motor 24. The first pulley 21 is provided on the right end portion of the guide rail 20. The second pulley 22 is provided on the left end portion of the guide rail 20. The belt 23 is wound around the first pulley 21 and the second pulley 22. Although the motor 24 is connected to the first pulley 21 in this preferred embodiment, the motor 24 may alternatively be connected to the second pulley 22. Driving the motor 24 actuates the first pulley 21 so as to cause the belt 23 to run between the first pulley 21 and the second pulley 22.

As illustrated in FIG. 2, the carriage 30 is attached to the belt 23. The carriage 30 is in engagement with the guide rail 20. Running of the belt 23 caused by the first moving mechanism 51 moves the carriage 30 along the guide rail 20 in the main scanning direction X.

The second moving mechanism 52 causes the recording medium 5 placed on the platen 25 to move in the sub-scanning direction Y. In this preferred embodiment, the rear of the printer 100 is the upstream side of the printer 100, and the front of the printer 100 is the downstream side of the printer 100. When the recording medium 5 moves from the rear of the printer 100 to the front of the printer 100 during printing, the recording medium 5 moves from the upstream side to the downstream side. The second moving mechanism 52 includes: a plurality of grit rollers 26; a plurality of pinch rollers 27 each disposed above an associated one of the grit rollers 26; and a motor 28 (see FIG. 5). The grit rollers 26 are connected with the motor 28. Driving the motor 28 rotates the grit rollers 26. The pinch rollers 27 are movable in an up-down direction. With the recording medium 5 sandwiched between each grit roller 26 and the associated pinch roller 27, rotation of the grit rollers 26 conveys the recording medium 5 in the front-rear direction (i.e., the sub-scanning direction Y).

As illustrated in FIG. 3, the head 40 includes a primer discharge head 41, and a plurality of ink discharge heads 42. The primer discharge head 41 and the ink discharge heads 42 are disposed above the platen 25 (see FIG. 2). The primer discharge head 41 and the ink discharge heads 42 are mounted on the carriage 30. The primer discharge head 41 and the ink discharge heads 42 are disposed side by side in the main scanning direction X. The primer discharge head 41 and the ink discharge heads 42 are disposed at identical positions in the sub-scanning direction Y. Alternatively, the primer discharge head 41 and the ink discharge heads 42 may be disposed at different positions in the sub-scanning direction Y. Together with the carriage 30, the primer discharge head 41 and the ink discharge heads 42 move along the guide rail 20 (see FIG. 2) in the main scanning direction X. The bottom surface of the primer discharge head 41 is provided with a plurality of nozzles 41*a*. Each nozzle 41*a* is an example of a "first nozzle". The bottom surface of each of the ink discharge heads 42 is provided with a plurality of nozzles 42*a*. Each nozzle 42*a* is an example of a "second nozzle". The nozzles 41*a* of the primer discharge head 41 are aligned in a row in the sub-scanning direction Y. The nozzles 42*a* of each ink discharge head 42 are aligned in a row in the sub-scanning direction Y. Primer is discharged from the nozzles 41*a* of the primer discharge head 41. Image-forming ink is discharged from the nozzles 42*a* of the ink discharge heads 42. Although the primer discharge head 41 is singular in number in this preferred embodiment, the number of primer discharge heads 41 is not limited to any particular number. Although the ink discharge heads 42 are four in number in this preferred embodiment, the number of ink discharge heads 42 is not limited to any particular number.

Figure 4:
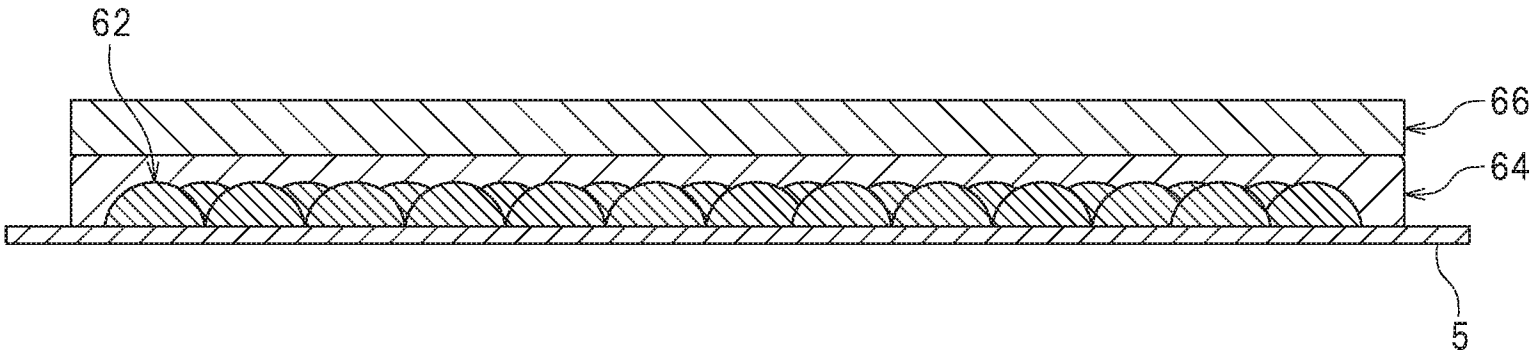
FIG. 4 is a cross-sectional view of a recording medium that has undergone printing.

The primer is used to increase fixability of the image-forming ink to the recording medium 5. The primer is photo-curable. The primer is adhesive. The primer is more adhesive than the image-forming ink. In other words, the adhesion of the primer is higher than the adhesion of the image-forming ink. The primer has the property of being cured by application of light (e.g., ultraviolet light) thereto. The primer contains no coloring agent, such as a pigment. The primer contains a photopolymerization monomer, a photopolymerization initiator system, and a binding agent (e.g., binder resin). When necessary, the primer contains various other additives. Examples of the additives may include a photosensitizer, a polymerization inhibitor, a scavenger, an antioxidant, an ultraviolet light absorber, a plasticizer, a surface conditioner, a leveling agent, a thickener, a disperser, an antifoaming agent, an antiseptic, and a solvent. The primer may be, for example, transparent, white, or gray in color. As illustrated in FIG. 4, a first primer layer and a second primer layer 64 each made of the primer are provided between the recording medium 5 and an image-forming ink layer 66 made of the image-forming ink (which will hereinafter be simply referred to as an "ink layer 66"). This increases fixability of the ink layer 66 to the recording medium 5. The color of the primer is not limited to any particular color.

The image-forming ink is used to form a print image on the recording medium 5. The image-forming ink is photo-curable. The image-forming ink is adhesive. The image-forming ink has the property of being cured by application of light (e.g., ultraviolet light) thereto. The image-forming ink contains: a coloring agent, such as a pigment; a photopolymerization monomer; and a photopolymerization initiator system. When necessary, the image-forming ink contains various other additives. Examples of the additives may include a photosensitizer, a polymerization inhibitor, a scavenger, an antioxidant, an ultraviolet light absorber, a plasticizer, a surface active agent, a leveling agent, a thickener, a disperser, an antifoaming agent, an antiseptic, and a solvent. The image-forming ink is colored ink. The image-forming ink is process color ink, for example. Examples of the process color ink include cyan ink, magenta ink, yellow ink, black ink, light cyan ink, and light magenta ink. In this preferred embodiment, cyan ink, magenta ink, yellow ink, and black ink are each discharged from the nozzles 42*a* of an associated one of the ink discharge heads 42.

The first ultraviolet light applicator 55 and the second ultraviolet light applicator 56 apply light (which is typically ultraviolet light) to the primer and image-forming ink discharged onto the recording medium 5. The first ultraviolet light applicator 55 is an example of a "first light source". The second ultraviolet light applicator 56 is an example of a "second light source". In this preferred embodiment, the first ultraviolet light applicator 55 applies light to the primer, discharged onto the recording medium 5, so as to cure the primer, thus forming the first primer layer 62 (see FIG. 4). The second ultraviolet light applicator 56 applies light to the primer, discharged onto the recording medium 5 and the first primer layer 62, so as to cure the primer, thus forming the second primer layer 64 (see FIG. 4). The first ultraviolet light applicator 55 applies light to the image-forming ink, discharged onto the second primer layer 64, so as to cure the image-forming ink, thus forming the ink layer 66 (see FIG. 4). As illustrated in FIG. 3, the first ultraviolet light applicator 55 and the second ultraviolet light applicator 56 are provided on the carriage 30. Together with the carriage 30, the first ultraviolet light applicator 55 and the second ultraviolet light applicator 56 move along the guide rail 20 (see FIG. 2) in the main scanning direction X. The first ultraviolet light applicator 55 and the second ultraviolet light applicator 56 are disposed at positions deviated from each other in the sub-scanning direction Y. The first ultraviolet light applicator 55 is disposed rightward of the rightmost one of the ink discharge heads 42. The first ultraviolet light applicator 55 overlaps with the nozzles 41*a* of the primer discharge head 41 as viewed in the main scanning direction X. The first ultraviolet light applicator 55 and the primer discharge head 41 are disposed at identical positions in the sub-scanning direction Y. The second ultraviolet light applicator 56 is disposed leftward of the primer discharge head 41. The second ultraviolet light applicator 56 is disposed downstream of the nozzles 41*a* of the primer discharge head 41 in the sub-scanning direction Y. The second ultraviolet light applicator 56 is disposed forward of the nozzles 41*a*. The first ultraviolet light applicator 55 and the second ultraviolet light applicator 56 are disposed at positions deviated from each other in the main scanning direction X. The second ultraviolet light applicator 56 is disposed forward of the first ultraviolet light applicator 55.

FIG. 4 is a cross-sectional view of the recording medium 5 that has undergone printing. As illustrated in FIG. 4, the first primer layer 62 made of the primer is formed on the recording medium 5, the second primer layer 64 made of the primer is formed on the recording medium 5 and the first primer layer 62, and the ink layer 66 made of the image-forming ink is formed on the second primer layer 64. The first primer layer 62, the second primer layer 64, and the ink layer 66 are respectively formed by a first controller 72, a second controller 74, and a third controller 76 of the controller 70 (which will be described below).

Primer droplets discharged onto the recording medium 5 spread out on the recording medium 5 until ultraviolet light is applied from the first ultraviolet light applicator 55. Primer droplets discharged onto the recording medium 5 and the first primer layer 62 spread out on the recording medium 5 and the first primer layer 62 until ultraviolet light is applied from the second ultraviolet light applicator 56. In these cases, each primer droplet spreads out separately, while adjacent primer droplets merge together and spread out gradually. Applying ultraviolet light to the primer droplets discharged onto the recording medium 5 or the primer droplets discharged onto the recording medium 5 and the first primer layer 62 cures the primer droplets such that the primer droplets maintain their spread state. Suppose that a time interval between discharge of the primer onto the recording medium 5 (or discharge of the primer onto the recording medium 5 and the first primer layer 62) from the nozzles 41*a* and application of ultraviolet light to the primer discharged is long (or longer than a predetermined first time, for example). In such a case, the primer droplets that have spread out in accordance with the time interval are cured. Thus, the surfaces of layers made of the primer droplets (e.g., the surfaces of the first primer layer 62 and the second primer layer 64) will be flat. Printing that makes the surfaces of layers flat in this manner will be referred to as "glossy printing". Suppose that the time interval between discharge of the primer onto the recording medium 5 (or discharge of the primer onto the recording medium 5 and the first primer layer 62) from the nozzles 41*a* and application of ultraviolet light to the primer discharged is short (or shorter than the predetermined first time, for example). In such a case, the primer droplets are cured without being spread out so much. In other words, each primer droplet merges with its adjacent primer droplet so as to form a new droplet, so that the new droplet maintaining its dome shape is cured. Thus, the layers (e.g., the first primer layer 62 and the second primer layer 64) made of the primer droplets have uneven surfaces, because the primer droplets in this case maintain their shapes unlike glossy printing. Printing that makes the surfaces of layers uneven in this manner will be referred to as "mat printing". When mat printing is effected, primer is normally not present over an entirety of a substrate (e.g., the recording medium 5) but is scattered over the substrate, so that gaps may exist between the scattered primers. This means that the first primer layer 62 may be regarded as a collection of a plurality of scattered primers.

In this preferred embodiment, the first time between discharge of the primer from the nozzles 41*a* onto the recording medium 5 and start of application of ultraviolet light from the first ultraviolet light applicator 55 to the primer discharged is shorter than a second time between discharge of the primer from the nozzles 41*a* onto the first primer layer 62 and the recording medium 5 and start of application of ultraviolet light from the second ultraviolet light applicator 56 to the primer discharged. The first time and the second time may be appropriately adjusted by changing, for example, the position of the primer discharge head 41, the position of the first ultraviolet light applicator 55, the position of the second ultraviolet light applicator 56, the speed of movement of the carriage 30, and/or the speed of movement of the recording medium 5. Alternatively, the first time may be longer than the second time, or the first time may be equal to the second time.

Figure 5:
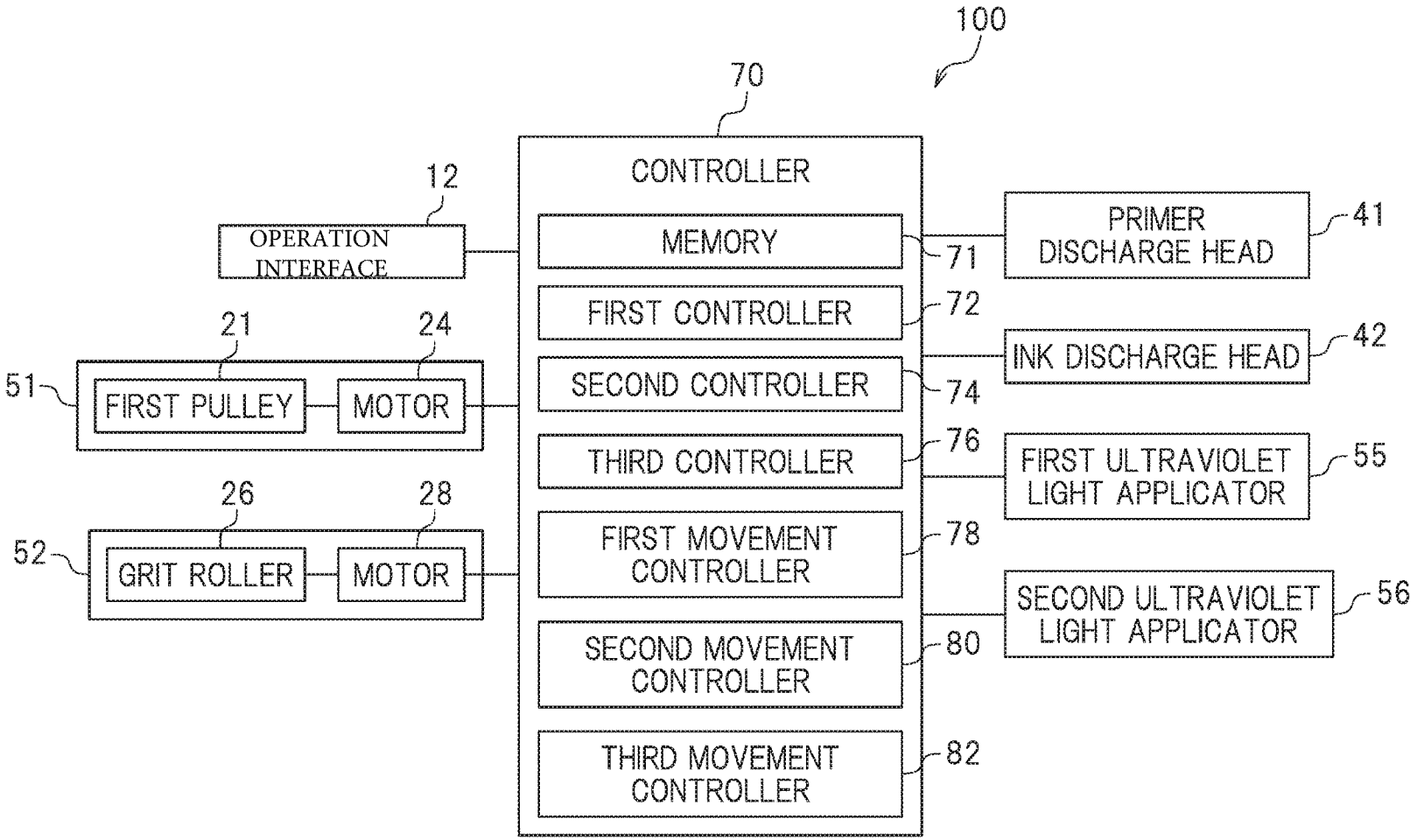
FIG. 5 is a block diagram of the printer according to the first preferred embodiment of the present invention.

As illustrated in FIG. 5, the controller 70 controls printing to be effected on the recording medium 5. The controller 70 preferably is a microcomputer, for example. The controller 70 is provided inside the body 10. The controller 70 includes a central processing unit (CPU), a read-only memory (ROM) storing, for example, a program to be executed by the CPU, and a random-access memory (RAM). In this preferred embodiment, printing-related control is carried out using the program stored in the microcomputer.

As illustrated in FIG. 5, the controller 70 is electrically connected to the operation interface 12, the motor 24 of the first moving mechanism 51, the motor 28 of the second moving mechanism 52, the primer discharge head 41, the ink discharge heads 42, the first ultraviolet light applicator 55, and the second ultraviolet light applicator 56. The controller 70 controls the operation interface 12, the motor 24, the motor 28, the primer discharge head 41, the ink discharge heads 42, the first ultraviolet light applicator 55, and the second ultraviolet light applicator 56.

Figure 6:
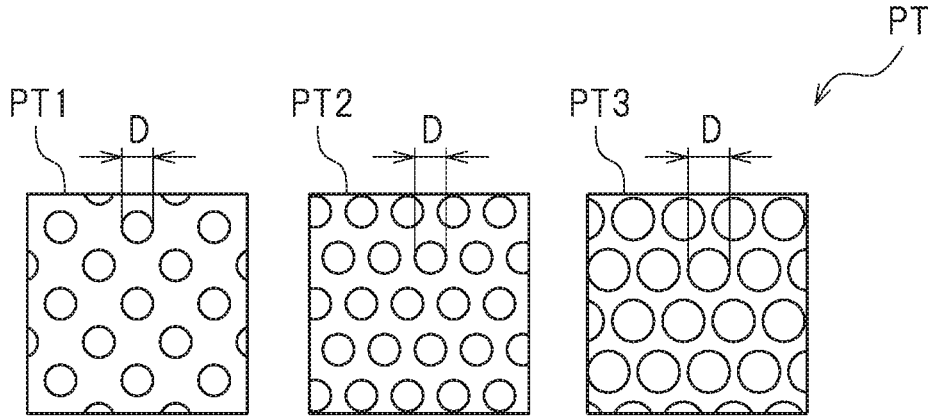
FIG. 6 is a schematic diagram illustrating primer discharge patterns according to the first preferred embodiment of the present invention.

The controller 70 receives printing-related information from the operation interface 12. In one example, the controller 70 receives a signal for a primer discharge pattern PT (see FIG. 6) selected by an operation performed on the operation input 12*b* (see FIG. 1) by the user. The primer discharge pattern PT will be described below. The controller 70 controls driving of the motor 24 of the first moving mechanism 51 so as to control rotation of the first pulley 21 and running of the belt 23 (see FIG. 2). Thus, the controller 70 controls movement of the primer discharge head 41, the ink discharge heads 42, the first ultraviolet light applicator 55, and the second ultraviolet light applicator 56 in the main scanning direction X. The controller 70 controls driving of the motor 28 of the second moving mechanism 52 so as to control rotation of the grit rollers 26. Thus, the controller 70 controls movement of the recording medium 5, placed on the platen 25, in the sub-scanning direction Y.

The controller 70 controls the primer discharge head 41 so as to control the sizes of primer droplets and the timing of discharge of the primer from the nozzles 41*a* of the primer discharge head 41. The controller 70 controls the ink discharge heads 42 so as to control the sizes of image-forming ink droplets and the timing of discharge of the image-forming ink from the nozzles 42*a* of the ink discharge heads 42. The controller 70 controls the first ultraviolet light applicator 55 so as to control the timing of application of ultraviolet light from the first ultraviolet light applicator 55 toward the recording medium 5 placed on the platen 25. The controller 70 controls the second ultraviolet light applicator 56 so as to control the timing of application of ultraviolet light from the second ultraviolet light applicator 56 toward the recording medium 5 placed on the platen 25.

As illustrated in FIG. 5, the controller 70 includes a memory 71, the first controller 72, the second controller 74, the third controller 76, a first movement controller 78, a second movement controller 80, and a third movement controller 82. The functions of the components of the controller 70 just mentioned may be implemented by software or hardware. In one example, the functions of the components of the controller 70 just mentioned may be performed by processor(s) or may be incorporated into circuit(s).

The memory 71 preliminarily stores a print image to be printed on the recording medium 5. The memory 71 preliminarily stores the primer discharge pattern PT illustrated in FIG. 6. The discharge pattern PT is presented on the display screen 12*a* (see FIG. 1) of the operation interface 12. The discharge pattern PT presented on the display screen 12*a* is a print image to be provided by effecting mat printing. When glossy printing is effected in accordance with the discharge pattern PT, the primer spreads out such that the primer is present over an entirety of the recording medium 5. The discharge pattern PT includes, for example, a plurality of primer discharge patterns, i.e., primer discharge patterns PT1, PT2, and PT3. In a dot pattern, such as the discharge pattern PT1, PT2, or PT3, each dot (or circle) has a diameter D of about 0.05 mm to about 0.4 mm, for example. Repetitive lengthwise and widthwise intervals between the dots of each pattern are about 0.1 mm to about 0.8 mm, for example. These numerical values may be appropriately set by the user. Forming the first primer layer 62 most preferably involves effecting mat printing such that the discharge pattern PT is the discharge pattern PT2, each dot has a diameter of about 0.2 mm, and repetitive lengthwise and widthwise intervals between the dots of the pattern are about 0.3 mm, for example. Because projections and depressions are formed on the first primer layer 62 in a regular and repetitive manner, the area of adhesion of the first primer layer 62 to the second primer layer 64 increases so as to provide sufficient adhesion between the first primer layer 62 and the second primer layer 64. Consequently, the second primer layer 64 will not have a raised portion resulting from a gap between the second primer layer 64 and the first primer layer 62.

Figure 7:
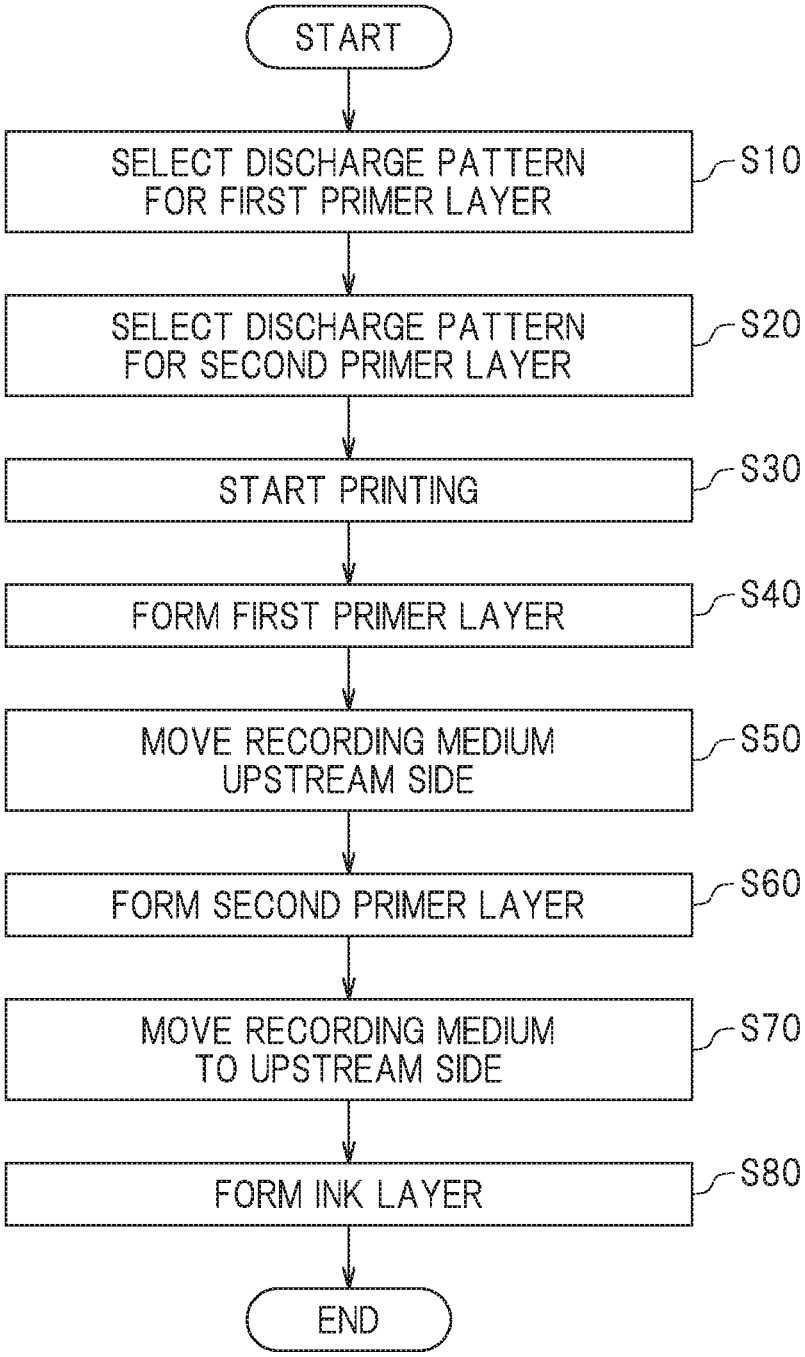
FIG. 7 is a flow chart illustrating the procedure of printing to be effected on a record medium by the printer.

The procedure of printing to be effected on the recording medium 5 by the printer 100 will be described below. FIG. 7 is a flow chart illustrating the procedure of printing to be effected on the recording medium 5 by the printer 100. As illustrated in FIG. 4, the first primer layer 62 made of the primer, the second primer layer 64 made of the primer, and the ink layer 66 made of the image-forming ink are stacked on the recording medium 5 in this order, thus providing a printed matter. In this preferred embodiment, a print region is defined in advance on the recording medium 5 before printing is effected on the recording medium 5. The print region is a region that undergoes printing effected using the primer and printing effected using the image-forming ink. The primer used to form the first primer layer 62 is similar in composition to the primer used to form the second primer layer 64.

In step S10, the user selects, from the primer discharge patterns PT1 to PT3 (see FIG. 6) presented on the display screen 12*a*, the discharge pattern PT to be used to form the first primer layer 62 using the primer. In this preferred embodiment, the user operates the operation input 12*b* so as to select the discharge pattern PT2, for example. The user sets the size of each primer droplet and the amount of primer to be discharged. The size of each primer droplet is the diameter of each dot when the primer hits a target. The resolution of the resulting image is dependent on the diameter of each dot when the primer hits a target.

In step S20, the user selects, from the primer discharge patterns PT1 to PT3 (see FIG. 6) presented on the display screen 12*a*, the discharge pattern PT to be used to form the second primer layer 64 using the primer. In this preferred embodiment, the user operates the operation input 12*b* so as to select the discharge pattern PT2, for example. The user sets the size of each primer droplet and the amount of primer to be discharged. The size of each primer droplet is the diameter of each dot when the primer hits a target. The resolution of the resulting image is dependent on the diameter of each dot when the primer hits a target. The discharge pattern PT used for formation of the first primer layer may be different from the discharge pattern PT used for formation of the second primer layer 64.

In step S30, printing is started. The user presses, for example, a printing start button (not illustrated) of the operation input 12*b* so as to start printing. In this preferred embodiment, pressing the printing start button transmits a signal indicating information on the discharge pattern PT2 selected in step S10 and a signal indicating information on the discharge pattern PT2 selected in step S20 to the controller 70.

In step S40, the first primer layer 62 is formed. Specifically, referring to FIG. 5, the third movement controller first controls driving of the motor 24 of the first moving mechanism 51 such that the head 40 moves in the main scanning direction X. During passage of the primer discharge head 41 above the print region on the recording medium 5, the first controller causes the primer discharge head 41 to discharge, from the nozzles 41*a*, the primer onto the recording medium 5 placed on the platen 25. The first controller 72 controls the primer discharge head 41 such that the primer is discharged in accordance with the discharge pattern PT2 (see FIG. 6) selected in step S10. During subsequent passage of the first ultraviolet light applicator 55 above the primer, the first controller 72 causes the first ultraviolet light applicator 55 to apply ultraviolet light to the primer discharged, so as to cure the primer. Thus, the primer for a single round of scanning is cured on the recording medium 5. In this preferred embodiment, the primer discharge head 41 and the first ultraviolet light applicator 55 are disposed at identical positions in the sub-scanning direction Y, so that the primer is curable simultaneously with a single round of scanning during which the primer is discharged from the nozzles 41*a*.

Next, the first movement controller 78 controls driving of the motor 28 of the second moving mechanism 52 such that the recording medium 5 placed on the platen 25 moves from the upstream side to the downstream side (i.e., from the rear to the front in this preferred embodiment) in the sub-scanning direction Y relative to the primer discharge head 41 and the ink discharge heads 42. The recording medium 5 is moved by a distance corresponding to a single round of scanning, for example. Then, the primer is discharged in accordance with the discharge pattern PT2 while the third movement controller 82 moves the head 40 in the main scanning direction X, so that the primer for a next round of scanning is cured on the recording medium 5. The head 40 is moved in the main scanning direction X and the recording medium 5 placed on the platen 25 is moved from the upstream side to the downstream side alternately in the above-described manner. Thus, the first controller 72 forms the first primer layer 62 on the recording medium 5. In this preferred embodiment, the time interval between discharge of the primer from the nozzles 41*a* and application of ultraviolet light to the primer is adjusted to be shorter than the predetermined first time. Consequently, projections and depressions are formed on the surface of the first primer layer 62.

In step S50, after the first primer layer 62 has been formed on the recording medium 5, the second movement controller 80 controls driving of the motor 28 of the second moving mechanism 52 such that the recording medium 5 placed on the platen 25 moves from the downstream side to the upstream side (i.e., from the front to the rear in this preferred embodiment) in the sub-scanning direction Y relative to the primer discharge head 41 and the ink discharge heads 42. Specifically, the second movement controller 80 controls driving of the motor 28 of the second moving mechanism 52 such that the recording medium 5 placed on the platen 25 returns to a start position where printing has started.

In step S60, after the recording medium 5 placed on the platen 25 has returned to the start position (i.e., after the movement of the recording medium 5 to the upstream side in the sub-scanning direction Y has been completed), the second primer layer 64 is formed on the recording medium 5 and the first primer layer 62. Specifically, referring to FIG. 5, the third movement controller 82 first controls driving of the motor 24 of the first moving mechanism 51 such that the head 40 moves in the main scanning direction X. During passage of the primer discharge head 41 above the print region on the recording medium 5, the second controller 74 causes the primer discharge head 41 to discharge, from the nozzles 41*a*, the primer onto the recording medium 5 placed on the platen 25 and onto the first primer layer 62. The second controller 74 controls the primer discharge head 41 such that the primer is discharged in accordance with the discharge pattern PT2 (see FIG. 6) selected in step S20. Subsequently, the first movement controller 78 controls driving of the motor 28 of the second moving mechanism 52 such that the recording medium 5 placed on the platen 25 moves from the upstream side to the downstream side (i.e., from the rear to the front in this preferred embodiment) in the sub-scanning direction Y relative to the primer discharge head 41 and the ink discharge heads 42. The recording medium 5 is moved by a distance corresponding to a single round of scanning, for example. The primer is discharged in accordance with the discharge pattern PT2 while the third movement controller moves the head 40 in the main scanning direction X. Concurrently with this, during passage of the second ultraviolet light applicator 56 above the primer discharged in the course of the preceding round of scanning, the second controller 74 causes the second ultraviolet light applicator 56 to apply ultraviolet light to the primer discharged, so as to cure the primer. Thus, the primer for a single round of scanning is cured on the recording medium 5 and the first primer layer 62. In this preferred embodiment, the second ultraviolet light applicator 56 is disposed forward of the primer discharge head 41, so that the second ultraviolet light applicator 56 does not cure the primer simultaneously with a single round of scanning during which the primer is discharged from the nozzles 41*a* but cures the primer after a delay of a single round of scanning.

The head 40 is moved in the main scanning direction X and the recording medium 5 placed on the platen 25 is moved from the upstream side to the downstream side alternately in the above-described manner. Thus, the second controller 74 forms the second primer layer 64 on the recording medium 5 and the first primer layer 62. In this preferred embodiment, the time interval between discharge of the primer from the nozzles 41*a* and application of ultraviolet light to the primer is adjusted to be equal to or longer than the predetermined first time. Consequently, the second primer layer 64 has a flat surface.

In step S70, after the second primer layer 64 has been formed on the recording medium 5 and the first primer layer 62, the second movement controller 80 controls driving of the motor of the second moving mechanism 52 such that the recording medium 5 placed on the platen 25 moves from the downstream side to the upstream side (i.e., from the front to the rear in this preferred embodiment) in the sub-scanning direction Y relative to the primer discharge head 41 and the ink discharge heads 42. Specifically, the second movement controller 80 controls driving of the motor 28 of the second moving mechanism 52 such that the recording medium 5 placed on the platen 25 returns to the start position where printing has started.

In step S80, after the recording medium 5 placed on the platen 25 has returned to the start position (i.e., after the movement of the recording medium 5 to the upstream side in the sub-scanning direction Y has been completed), the ink layer 66 is formed on the second primer layer 64. Specifically, referring to FIG. 5, the third movement controller 82 first controls driving of the motor 24 of the first moving mechanism 51 such that the head 40 moves in the main scanning direction X. During passage of the ink discharge heads 42 above the second primer layer 64, the third controller 76 causes the ink discharge heads 42 to discharge, from the nozzles 42*a*, the image-forming ink onto the second primer layer 64. The third controller 76 controls the ink discharge heads 42 such that the image-forming ink is discharged in accordance with the print image stored in the memory 71. During subsequent passage of the first ultraviolet light applicator 55 above the image-forming ink, the third controller 76 causes the first ultraviolet light applicator 55 to apply ultraviolet light to the image-forming ink discharged, so as to cure the image-forming ink. Thus, the image-forming ink for a single round of scanning is cured on the second primer layer 64. The head 40 is moved in the main scanning direction X and the recording medium 5 placed on the platen 25 is moved from the upstream side to the downstream side in an alternating manner. Consequently, the third controller 76 forms the ink layer 66 on the second primer layer 64. Performing the above-described steps completes the procedure of printing the print image stored in the memory 71.

Suppose that projections and depressions are formed on the surface of the second primer layer 64, and differences in height between the projections and depressions are large. In such a case, variations may occur in the thickness of the ink layer 66 formed on the second primer layer 64. If the ink layer 66 has a non-uniform thickness, a color difference may unfortunately occur in a region of the ink layer 66 defined by the image-forming ink of the same color. In this preferred embodiment, however, the second primer layer 64 has a flat surface. This makes the thickness of the ink layer 66 uniform or substantially uniform, and thus reduces the color difference in the ink layer 66.

As described above, the printer 100 according to this preferred embodiment is constructed such that the first controller 72 forms the first primer layer 62 on the recording medium 5, the second controller 74 forms the second primer layer 64 on the first primer layer 62 and the recording medium 5, and the third controller 76 forms the ink layer 66 on the second primer layer 64. Forming the second primer layer 64 on the first primer layer 62 and the recording medium 5 in this manner further increases adhesion between the first primer layer 62 and the recording medium 5. Forming the ink layer 66 on the second primer layer 64 improves the ink layer 66 in quality and increases fixability of the ink layer 66 to the recording medium 5.

The printer 100 according to this preferred embodiment is constructed such that the first time between discharge of the primer from the nozzles 41*a* of the primer discharge head 41 onto the recording medium 5 and start of application of ultraviolet light from the first ultraviolet light applicator 55 to the primer discharged is shorter than the second time between discharge of the primer from the nozzles 41*a* onto the first primer layer 62 and the recording medium 5 and start of application of ultraviolet light from the second ultraviolet light applicator 56 to the primer discharged. As the time between discharge of the primer and application of ultraviolet light decreases, the projections and depressions on the surface of the primer layer will be larger. As the time between discharge of the primer and application of ultraviolet light increases, the primer will spread out accordingly. This makes the projections and depressions on the surface of the primer layer smaller, so that the surface of the primer layer tends to be flat. In this preferred embodiment, the second time is longer than the first time. Thus, the projections and depressions on the surface of the second primer layer 64 are smaller than the projections and depressions on the surface of the first primer layer 62, resulting in a reduction in color difference in the ink layer 66.

The printer 100 according to this preferred embodiment is constructed such that the primer discharge head 41 and the ink discharge heads 42 are disposed side by side in the main scanning direction X, the first ultraviolet light applicator 55 overlaps with the nozzles 41*a* of the primer discharge head 41 as viewed in the main scanning direction X, and the second ultraviolet light applicator 56 is disposed downstream of the nozzles 41*a* in the sub-scanning direction Y. This enables appropriate adjustment of the time between discharge of the primer and application of ultraviolet light. Consequently, this preferred embodiment makes it possible to form each of the first primer layer 62 and the second primer layer 64 into a desired shape, provide sufficient adhesion between the recording medium 5 and the first primer layer 62, and reduce color differences in the ink layer 66.

The printer 100 according to this preferred embodiment is able to effect printing on the recording medium 5 made of a material permeable neither to the primer nor to the image-forming ink. Forming a primer layer by discharging primer onto a recording medium made of a material permeable neither to primer nor to image-forming ink provides sufficient fixability of an ink layer to the recording medium. This normally forms a large number of projections and depressions on the primer layer, so that the color difference in the ink layer tends to increase. In this preferred embodiment, however, the surface of the second primer layer 64 on which the ink layer 66 is to be formed is more flattened than the surface of a conventional primer layer. Consequently, this preferred embodiment reduces the color difference in the ink layer 66.

The printer 100 according to this preferred embodiment is constructed such that the second controller 74 forms the second primer layer 64 on the first primer layer 62 and the recording medium 5 after the first controller 72 has completed formation of the first primer layer 62 on the recording medium 5 and the second movement controller 80 has completed movement of the recording medium 5 to the upstream side in the sub-scanning direction Y. The third controller 76 forms the ink layer 66 on the second primer layer 64 after the second controller 74 has completed formation of the second primer layer 64 on the first primer layer 62 and the recording medium 5 and the second movement controller 80 has completed movement of the recording medium 5 to the upstream side in the sub-scanning direction Y. Thus, a single printing operation involves forming the first primer layer 62, the second primer layer 64, and the ink layer 66 in this order. This facilitates control exercised during printing.

Second Preferred Embodiment

Figure 8:
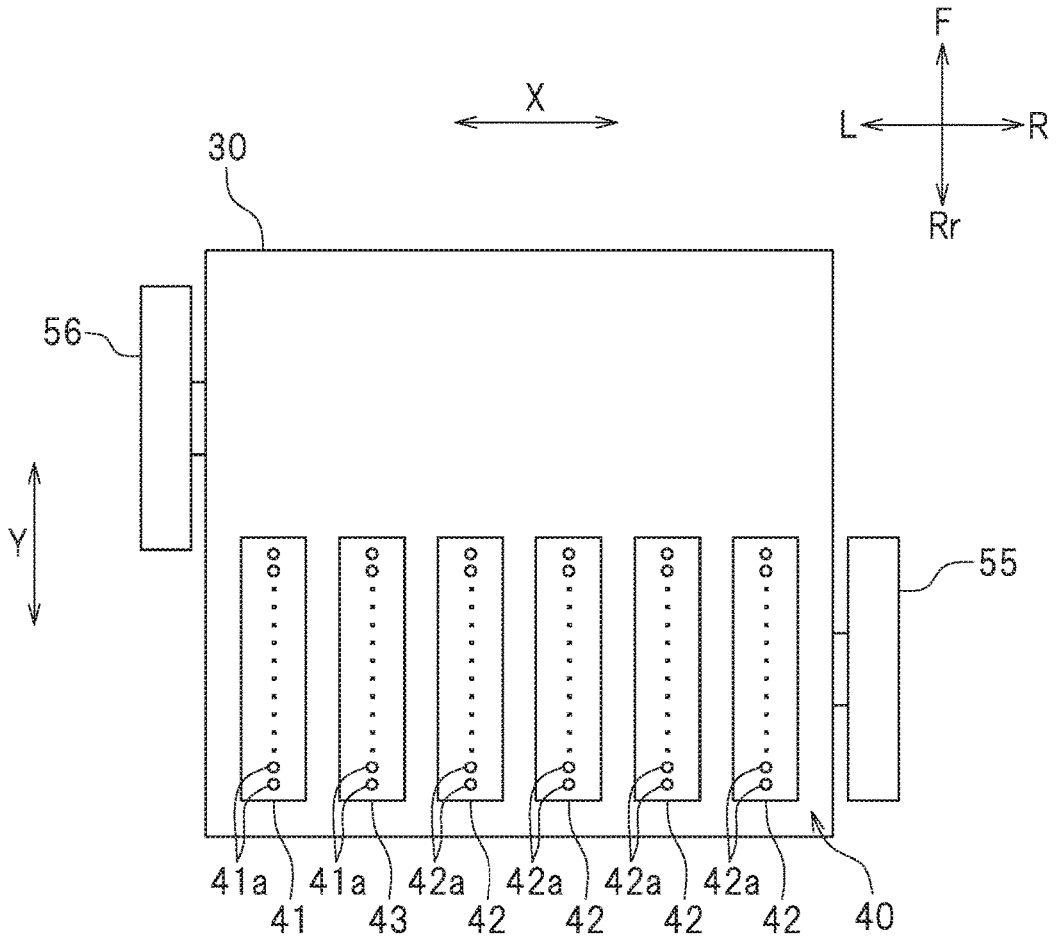
FIG. 8 is a bottom view of a head according to a second preferred embodiment of the present invention.

FIG. 8 is a bottom view of the head 40 according to a second preferred embodiment of the present invention. As illustrated in FIG. 8, the head 40 further includes a primer discharge head 43. In this preferred embodiment, the primer discharge head 41 discharges a first primer, and the primer discharge head 43 discharges a second primer. The second primer discharged from the primer discharge head 43 is different in composition from the first primer discharged from the primer discharge head 41. Alternatively, the first primer and the second primer used in the second preferred embodiment may each be similar to the primer used in the first preferred embodiment. In one example, primer having the property of being highly adhesive to the recording medium 5 is preferably used as the first primer, and primer having the property of being highly fixable to the ink layer 66 is preferably used as the second primer. The second primer preferably contains a surface conditioner including a crosslinking functional group such that the contact angle between the second primer and the image-forming ink is about 4 degrees to about 40 degrees, for example. In one example, the contact angle may be about 5 degrees to about 30 degrees, for example. Such a contact angle increases fixability of the ink layer 66 to the second primer layer 64. Examples of the first primer include primer containing three percent of a binding agent by mass, assuming that the total mass of the first primer is 100 percent by mass. Examples of the second primer include primer containing one percent of a binding agent by mass and seven percent of a surface conditioner by mass, assuming that the total mass of the second primer is 100 percent by mass.

As used herein, the term "contact angle" refers to a value (or more specifically a static contact angle) measured by a sessile drop method using a common contact angle meter. In one example, a contact angle measuring method involves automatically dropping droplets of 1.0 μL on the surface of an object of measurement at a temperature of 25° C. and a humidity of 50% using an automatic contact angle meter DM-501Hi manufactured by Kyowa Interface Science Co., Ltd. The method subsequently involves automatically capturing images of the droplets into analysis software (FAMAS) 15 seconds after dropping. The method then involves analyzing the shapes of the droplets on the basis of the captured images by an ellipse fitting method, thus measuring contact angles.

In step S40 of the flow chart illustrated in FIG. 7, the first controller 72 of the printer 100 according to this preferred embodiment causes the primer discharge head 41 to discharge, from the nozzles 41*a*, the first primer onto the recording medium 5, and then causes the first ultraviolet light applicator 55 to apply ultraviolet light to the first primer discharged, so as to form the first primer layer 62 on the recording medium 5.

In step S60 of the flow chart illustrated in FIG. 7, the second controller 74 causes the primer discharge head 43 to discharge, from the nozzles 41*a,* the second primer onto the first primer layer 62 and the recording medium 5, and then causes the second ultraviolet light applicator 56 to apply ultraviolet light to the second primer discharged, so as to form the second primer layer 64 on the first primer layer 62 and the recording medium 5.

The head 40 of the printer 100 according to this preferred embodiment includes: the primer discharge head 41 to discharge, from its nozzles 41*a,* the first primer that is photo-curable and more adhesive than the image-forming ink; and the primer discharge head 43 to discharge, from its nozzles 41*a,* the second primer that is photo-curable and more adhesive than the image-forming ink. The first primer differs in composition from the second primer. Thus, primer that enhances adhesion between the first primer layer 62 and the recording medium 5 may be appropriately selected and used as the first primer, and primer that increases fixability of the ink layer 66 to the recording medium 5 may be appropriately selected and used as the second primer. This makes it possible to provide a high-quality printed matter with enhanced adhesion between the first primer layer 62 and the recording medium 5.

Third Preferred Embodiment

Figure 9:
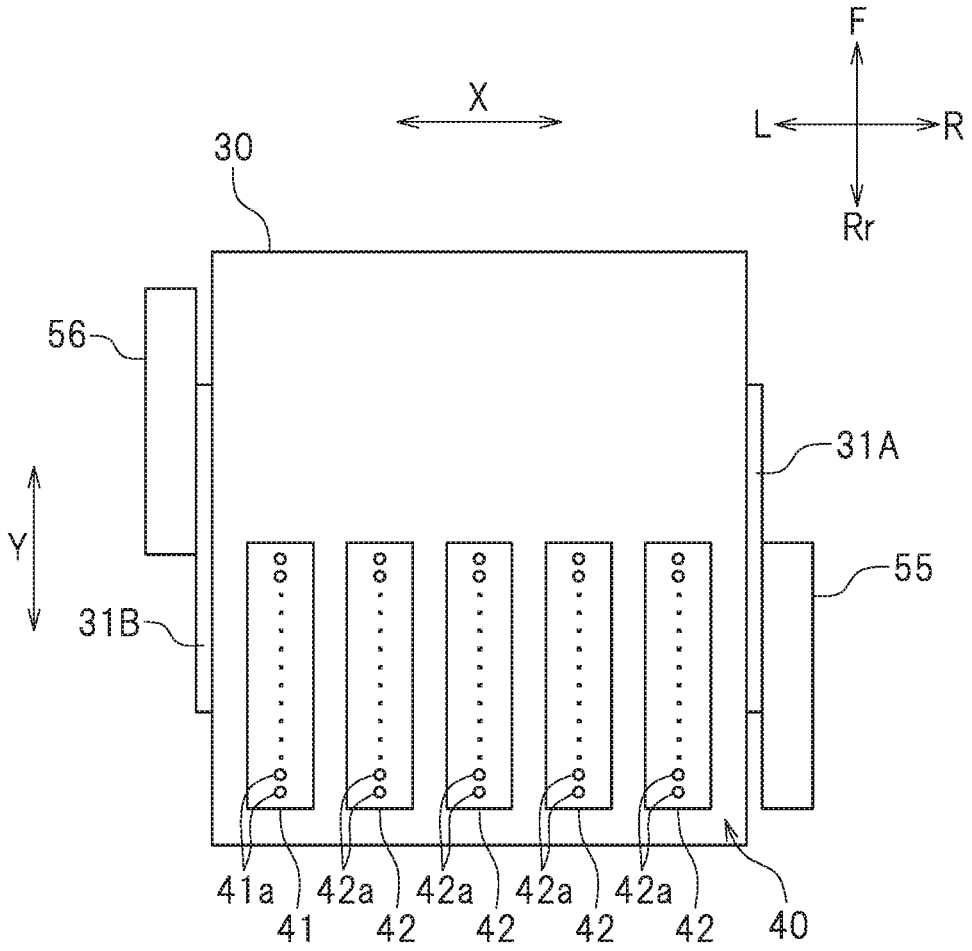
FIG. 9 is a bottom view of a head according to a third preferred embodiment of the present invention.

FIG. 9 is a bottom view of the head 40 according to a third preferred embodiment of the present invention. The first ultraviolet light applicator 55 is in engagement with a guide rail 31A provided on the carriage 30. The first ultraviolet light applicator 55 is attached to a first driving belt (not illustrated) provided on the carriage 30. Running of the first driving belt enables the first ultraviolet light applicator 55 to move in the sub-scanning direction Y. The second ultraviolet light applicator 56 is in engagement with a guide rail 31B provided on the carriage 30. The second ultraviolet light applicator 56 is attached to a second driving belt (not illustrated) provided on the carriage 30. Running of the second driving belt enables the second ultraviolet light applicator 56 to move in the sub-scanning direction Y. This structure makes it possible to change the positions of the first ultraviolet light applicator 55 and the second ultraviolet light applicator 56 relative to the carriage 30 in the sub-scanning direction Y. In this preferred embodiment, both of the first ultraviolet light applicator 55 and the second ultraviolet light applicator 56 are movable in the sub-scanning direction Y. Alternatively, only one of the first ultraviolet light applicator 55 and the second ultraviolet light applicator 56 may be movable in the sub-scanning direction Y.

The second ultraviolet light applicator 56 of the printer 100 according to this preferred embodiment is provided on the carriage 30 and movable in the sub-scanning direction Y. This enables stepless or substantially stepless adjustment of dimensions of projections and depressions on the surface of the second primer layer 64.

The first ultraviolet light applicator 55 of the printer 100 according to this preferred embodiment is provided on the carriage 30 and movable in the sub-scanning direction Y. This enables stepless or substantially stepless adjustment of dimensions of projections and depressions on the surface of the first primer layer 62.

In each of the foregoing preferred embodiments, the dot patterns PT1 to PT3 are preferably used as the discharge patterns, for example. Alternatively, any other patterns may be used. In one example, a linear pattern in which primer ink droplets are linearly continuous in a matrix may be provided. In another example, a combination of linear patterns extending in a plurality of directions may be provided. The discharge pattern may be uniform across the entire print region. A different discharge pattern may be used for only a specified region. The discharge pattern may be gradually changed when a transition is made from one region to another region.

In each of the foregoing preferred embodiments, the ink layer 66 is preferably formed on the second primer layer 64, for example. The ink layer 66, however, may be formed on any other suitable location. In one example, the ink layer 66 may be formed on the first primer layer 62. In this case, the primer is discharged from the nozzles 41*a* in accordance with the discharge pattern PT illustrated in FIG. 6, so as to form the first primer layer 62 in a matted manner. This provides special visual effects for the ink layer 66 formed on the first primer layer 62, such as the effect of making lines during printing inconspicuous and the effect of providing a unique texture, for example.

In each of the foregoing preferred embodiments, the first primer layer 62 preferably is formed in a matted manner, and the second primer layer 64 preferably is formed in a glossy manner, for example. The first primer layer 62 and the second primer layer 64 may each be formed in any other suitable manner. In one example, the first primer layer 62 may be formed in a glossy manner, and the second primer layer 64 may be formed in a matted manner. In another example, the first primer layer 62 and the second primer layer 64 may both be formed in a matted manner. In still another example, the first primer layer 62 and the second primer layer 64 may both be formed in a glossy manner.

In each of the foregoing preferred embodiments, the second primer layer 64 preferably is formed after an entirety of the first primer layer 62 has been formed, and the ink layer 66 preferably is formed after an entirety of the second primer layer 64 has been formed, for example. The first primer layer 62, the second primer layer 64, and the ink layer 66, however, may be formed in any other suitable manner. In one example, the first primer layer 62, the second primer layer 64, and the ink layer 66 may be formed for every few rounds of scanning.

In each of the foregoing preferred embodiments, the printer 100 preferably includes the platen 25, on which the recording medium 5 is to be placed, and has a structure such that the recording medium 5 is conveyed on the platen 25 in the sub-scanning direction Y, for example. The printer 100, however, is not limited to this configuration. In one example, the printer 100 may include, instead of the platen 25, a table to which the recording medium 5 is to be secured. The table may be movable in the sub-scanning direction Y, for example.

In each of the foregoing preferred embodiments, the second ultraviolet light applicator 56 preferably is disposed leftward of the first ultraviolet light applicator 55, for example. The second ultraviolet light applicator 56, however, may be disposed at any other suitable location. The second ultraviolet light applicator 56 may be disposed rightward of the first ultraviolet light applicator 55.

As described above, the functions of the memory 71, the first controller 72, the second controller 74, the third controller 76, the first movement controller 78, the second movement controller 80, and the third movement controller 82 of the controller 70 may be implemented by software. For example, a computer program may be read into a computer so as to implement the functions of the components of the controller 70 by the computer. A preferred embodiment of the present invention includes a printing computer program to allow the computer to function as the components of the controller 70. Another preferred embodiment of the present invention includes a non-transitory computer-readable storage medium that stores the computer program. The functions of the components of the controller 70 may be implemented by a single processor or a plurality of processors included in the controller 70. A further preferred embodiment of the present invention includes a circuit having functions similar to those of a program to be executed by each component of the controller 70.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet recording apparatus comprising:

a platen on which a recording medium is able to be placed;

a primer discharge head to discharge photo-curable primer onto the recording medium, the primer discharge head including a first nozzle;

an ink discharge head to discharge image-forming ink onto the recording medium, the image-forming ink being photo-curable and less adhesive than the primer, the ink discharge head including a second nozzle;

a light source to apply light to the primer and the image-forming ink discharged onto the recording medium;

a first moving mechanism to cause the primer discharge head and the ink discharge head to move in a main scanning direction corresponding to a width direction of the recording medium;

a second moving mechanism to cause the recording medium placed on the platen to move in a sub-scanning direction perpendicular to the main scanning direction; and a controller to control the primer discharge head, the ink discharge head, the light source, the first moving mechanism, and the second moving mechanism; wherein the controller includes:

a first controller to cause the primer discharge head to discharge, from the first nozzle, the primer onto the recording medium and then cause the light source to apply light to the primer discharged, to form a first primer layer on the recording medium;

a second controller to cause the primer discharge head to discharge, from the first nozzle, the primer onto the first primer layer and the recording medium and then cause the light source to apply light to the primer discharged, to form a second primer layer on the first primer layer and the recording medium; and a third controller to cause the ink discharge head to discharge, from the second nozzle, the image-forming ink onto the second primer layer and then cause the light source to apply light to the image-forming ink discharged, to form an image-forming ink layer on the second primer layer.

2. The inkjet recording apparatus according to claim 1, wherein a first time between discharge of the primer from the first nozzle onto the recording medium and start of application of light from the light source to the primer discharged is shorter than a second time between discharge of the primer from the first nozzle onto the first primer layer and the recording medium and start of application of light from the light source to the primer discharged.

3. The inkjet recording apparatus according to claim 2, wherein the light source includes:

a first light source to apply light to the primer discharged onto the recording medium; and a second light source to apply light to the primer discharged onto the first primer layer and the recording medium; wherein the primer discharge head and the ink discharge head are disposed side by side in the main scanning direction;

the first light source overlaps with the first nozzle as viewed in the main scanning direction; and the second light source is disposed downstream of the first nozzle in the sub-scanning direction.

4. The inkjet recording apparatus according to claim 3, further comprising a carriage on which the primer discharge head and the ink discharge head are disposed, the carriage being movable in the main scanning direction by the first moving mechanism, wherein the second light source is disposed on the carriage, the second light source being movable in the sub-scanning direction.

5. The inkjet recording apparatus according to claim 4, wherein the first light source is disposed on the carriage, the first light source being movable in the sub-scanning direction.

6. The inkjet recording apparatus according to claim 1, wherein the recording medium is made of a material permeable neither to the primer nor to the image-forming ink.

7. The inkjet recording apparatus according to claim 1, wherein the primer discharge head includes:

a first primer discharge head to discharge, from the first nozzle, first primer that is photo-curable and more adhesive than the image-forming ink; and a second primer discharge head to discharge, from the first nozzle, second primer that is photo-curable and more adhesive than the image-forming ink; wherein the first primer is different in composition from the second primer;

the first controller causes the first primer discharge head to discharge, from the first nozzle, the first primer onto the recording medium, and then causes the light source to apply light to the first primer discharged, to form the first primer layer on the recording medium; and the second controller causes the second primer discharge head to discharge, from the first nozzle, the second primer onto the first primer layer and the recording medium, and then causes the light source to apply light to the second primer discharged, to form the second primer layer on the first primer layer and the recording medium.

8. The inkjet recording apparatus according to claim 1, wherein the controller further includes:

a first movement controller to control the second moving mechanism such that the recording medium placed on the platen moves from an upstream side to a downstream side in the sub-scanning direction relative to the primer discharge head and the ink discharge head; and a second movement controller to control the second moving mechanism such that the recording medium placed on the platen moves from the downstream side to the upstream side in the sub-scanning direction relative to the primer discharge head and the ink discharge head; wherein the second controller forms the second primer layer on the first primer layer and the recording medium after the first controller has completed formation of an entirety of the first primer layer on the recording medium and the second movement controller has completed movement of the recording medium to the upstream side in the sub-scanning direction; and the third controller forms the image-forming ink layer on the second primer layer after the second controller has completed formation of an entirety of the second primer layer on the first primer layer and the recording medium and the second movement controller has completed movement of the recording medium to the upstream side in the sub-scanning direction.

9. A printing method comprising:

discharging photo-curable primer onto a recording medium;

forming a first primer layer on the recording medium by applying light to the primer discharged onto the recording medium;

discharging the primer onto the first primer layer and the recording medium;

forming a second primer layer on the first primer layer and the recording medium by applying light to the primer discharged onto the first primer layer and the recording medium;

discharging image-forming ink onto the second primer layer, the image-forming ink being photo-curable and less adhesive than the primer; and forming an image-forming ink layer on the second primer layer by applying light to the image-forming ink discharged.

* * * * *